United States Patent [19]

Ryno et al.

[11] 4,330,784

[45] May 18, 1982

[54] VARIABLE WAVEGUIDE CONTINUOUS SLOT ANTENNA

[75] Inventors: Gaylon E. Ryno; John G. Hoffman, both of Riverside, Calif.

[73] Assignee: The United States of America as represented by the Secretary of the Navy, Washington, D.C.

[21] Appl. No.: 616,432

[22] Filed: Feb. 13, 1967

[51] Int. Cl.[3] ..... H01Q 13/10

[52] U.S. Cl. ..... 343/771

[58] Field of Search ..... 343/767–771

[56] References Cited

U.S. PATENT DOCUMENTS 3,978,485 8/1976 Bonnaval ..... 343/767

*Primary Examiner*—T. H. Tubbesing

*Attorney, Agent, or Firm*—Robert F. Beers; Joseph M. St. Amand

[57] ABSTRACT

A continuous slot antenna having a rectangular waveguide whose broad dimension varies in proportion to the attenuation for providing improved radiation patterns.

5 Claims, 2 Drawing Figures

VARIABLE WAVEGUIDE CONTINUOUS SLOT ANTENNA

The invention herein described may be manufactured and used by or for the Government of the United States of America for governmental purposes without the payment of any royalties thereon or therefor.

This invention is related to and an improvement over U.S. patent application Ser. No. 465,807 filed June 21, 1965 by Glenn A. Scharp for Continuous Slot Antennas.

Prior devices have included various changes in dimensions of waveguide in attempting to alter the impedance thereof for matching of impedances to improve the efficiency of energy transfer. Prior art devices attempt to match impedances, whereas in the instant invention it is the phase of the radiated energy that is adjusted by varying the broad dimension of the rectangular waveguide of a continuous slot leaky wave antenna. In the instant invention it is assumed that the impedances are already matched and it is the phase that is adjusted to improve the shape of the radiation pattern; the phase being a function of the attenuation along the waveguide. It is an object of the invention, therefore, to improve the shape of radiation patterns of a continuous slot leaky wave waveguide antenna by varying the broad dimension of the waveguide.

Other objects and many of the attendant advantages of this invention will become readily appreciated as the same becomes better understood by reference to the following detailed description when considered in connection with the accompanying drawings wherein.

The continuous slot antenna consists of a long slot cut in the broad face of a rectangular waveguide propagating a $TE_{10}$ mode, as discussed in aforementioned U.S. patent application Ser. No. 465,807. The slot is positioned on one side of the waveguide centerline and slot coupling is controlled by varying the slot offset from the centerline to conform to a predetermined aperture distribution. Previous design techniques have used the approximation that the waveguide wavelength $\lambda g$ is constant and not a function of either waveguide or radiation losses. This assumption is valid for only very slightly coupled slots and therefore not valid for most continuous slot antenna designs. The result of using this assumption is that the main radiation beam is broadened and the gain is lowered beyond that which theory predicts. Also, the angular location, or look angle, of the main radiation beam is higher than that predicted by theory. The present invention, however, overcomes these inaccuracies by making the broad dimension, "a", of the waveguide vary as a function of the losses and thus cause $\lambda g$ to be a constant.

Figure 1:
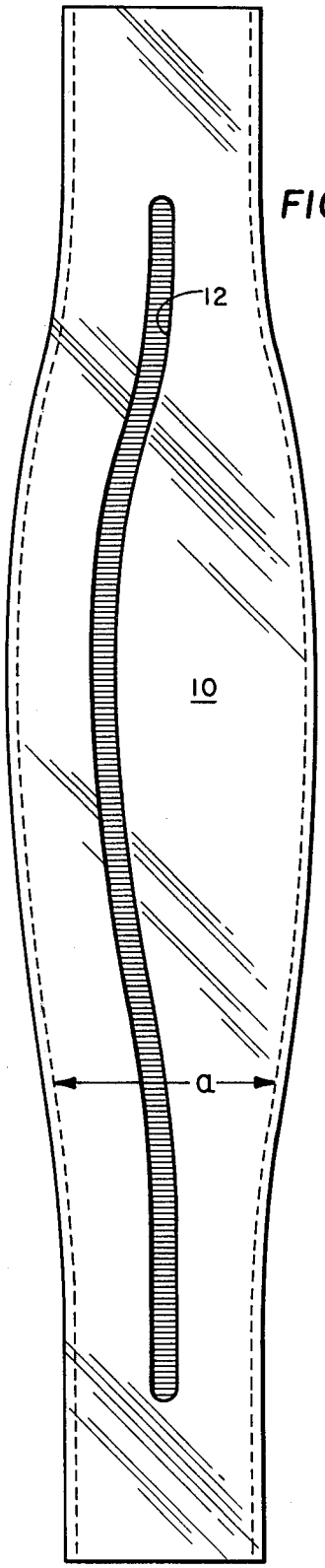
FIG. 1 shows a typical embodiment of the invention, a continuous slot waveguide antenna with a changing broad dimension along its length.
Figure 2:
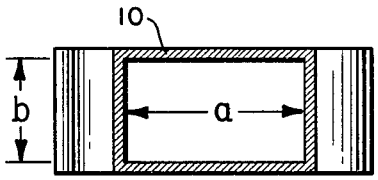
FIG. 2 is an end view of the antenna shown in FIG. 1.

As shown in FIGS. 1 and 2, the antenna consists of a rectangular section of waveguide 10 having a continuous curved slot 12 therein. The narrow side of the waveguide section has a constant dimension, "b", whereas the broadface of the waveguide has a varying dimension, "a", along the length thereof. By varying the "a" dimension along the broadface of the antenna waveguide section 10 as a function of the losses, $\lambda g$ is made a constant. This antenna has the particular advantage that the beamwidth and gain is improved and much more closely approximates that predicted by theory. The look angle is also adjusted to a value much closer to the theoretical value.

In this antenna the phase is a function of the attenuation along the length of the antenna. This is shown by the relationship $$\beta_t = K\sqrt{1+\left(\frac{\infty}{K}\right)^2}\ \mathrm{Cos}\ \theta$$

where:

$\beta t$ is the phase at the antenna interface, $K=(2\pi)/(\lambda)$, $\infty$ is the attenuation, and $\theta$ is the angle of emergence or look angle.

In the case of an antenna the attenuation $\infty$ is the result of both radiation and waveguide wall losses. Thus, if phase is to be accurately controlled the effect of radiation upon the phase must be considered. Other antenna design techniques do not include the effect of $\infty_r$, the radiation attenuation. For instance, prior antenna design techniques give the antenna look angle as $\mathrm{Cos}\ \theta=(\lambda)/(\lambda g)$ where $\lambda$ = wavelength in air, and $\lambda g$ = wavelength in the waveguide.

However, this invention corrects the phase for the effects of $\infty_r$ by varying the broad dimension, "a", of the antenna waveguide in accordance with the power distribution of the antenna. In the instant invention, the effect of the radiation attenuation $\infty_r$ is considered and the equation for the antenna look angle must be given as $$\mathrm{Cos}\ \theta = \frac{\lambda}{\lambda g\sqrt{1+\left(\frac{\infty_r\lambda}{2\pi}\right)^2}} \tag{1}$$

For a given look angle $\theta$, $\lambda g$ can readily be determined from equation (1) as follows:

$$\lambda g = \frac{\lambda}{\mathrm{Cos}\ \theta\sqrt{1-\left(\frac{\infty_r\lambda}{2\pi}\right)^2}} \tag{2}$$

Also, it is well known that, for the $TE_{10}$ mode $$\lambda g = \frac{\lambda}{\sqrt{1-\left(\frac{\lambda}{2a}\right)^2}} \tag{3}$$

where a = the dimension of the broadface of the antenna waveguide at any specific given point along the antenna length. Solving equation (3) for "a" gives $$a = \frac{\lambda}{2\sqrt{1-\left(\frac{\lambda}{\lambda g}\right)^2}} \tag{4}$$

where $\lambda g$ is determined from equation (2). Using equation (4) the broad dimension "a" of the antenna waveguide can be calculated at each point along the length of the antenna for a particular look angle.

Obviously many modifications and variations of the present invention are possible in the light of the above teachings. It is therefore to be understood that within the scope of the appended claims the invention may be practiced otherwise than as specifically described.

What is claimed is:

1. A continuous slot antenna having improved radiation pattern, comprising:

(a) a section of rectangular waveguide propagating a $TE_{10}$ mode, (b) a long continuous curved-slot in one broadface of said waveguide, (c) said slot being positioned to one side of the waveguide centerline, (d) the broad dimension of said section of rectangular waveguide being varied along its length for adjusting the phase of energy radiated therefrom.

2. An antenna as in claim 1 wherein the broad dimension of said section of waveguide is varied as a function of radiation along the length of said slot.

3. An antenna as in claim 1 wherein the antenna look angle $\theta$ is defined by the equation $$\cos\theta = \frac{\lambda}{\lambda g\sqrt{1+\left(\frac{\infty\lambda}{2\pi}\right)^2}}$$

where $\lambda$ = wavelength in air $\lambda g$ = wavelength in waveguide $\infty$ = attenuation.

4. An antenna as in claim 1 wherein the coupling of said slot is controlled by varying the distance said slot is offset from said waveguide centerline along the length thereof to conform to a predetermined slot aperture distribution.

5. An antenna as in claim 1 wherein for a constant given look angle, the broad dimension of the antenna waveguide at each point along the length of the antenna is defined by the equation $$a = \frac{\lambda}{2\sqrt{1-\left(\frac{\lambda}{\lambda g}\right)^2}}$$

where a = the broad dimension $\lambda$ = wavelength in air, and $\lambda g$ = wavelength in the waveguide.

* * * * *